United States Patent [19]

Higgins et al.

[11] 4,057,860

[45] Nov. 15, 1977

[54] BOX SPRING ASSEMBLY

[75] Inventors: Larry Higgins, Carthage; John Thomas King, Sarcoxie; Blondie Butler, Carthage, all of Mo.; Francis R. Struewing, deceased, late of Carthage, Mo., by Barbara C. Struewing, administratrix

[73] Assignee: Leggett & Platt, Incorporated, Carthage, Mo.

[21] Appl. No.: 621,496

[22] Filed: Oct. 10, 1975

[51] Int. Cl.[2] ..... A47C 23/02

[52] U.S. Cl. ..... 5/247; 5/257; 5/351

[58] Field of Search ..... 267/80; 5/247, 255, 5/259, 235, 351, 257

[56] References Cited

U.S. PATENT DOCUMENTS

| | | | |
|---|---|---|---|
| 488,060 | 12/1892 | Bunker | 5/255 |
| 2,610,334 | 9/1952 | Piliero | 5/351 |
| 3,087,169 | 4/1963 | Melen | 5/259 |
| 3,833,948 | 9/1974 | Surletta | 5/247 |

*Primary Examiner*—Casmir A. Nunberg
*Attorney, Agent, or Firm*—Wood, Herron & Evans

[57] ABSTRACT

A box spring assembly for use as a supporting foundation for a bed mattress. The assembly comprises a wooden frame, slats, spiral springs, edge coil springs, a border wire and a welded wire top grid. The spiral springs extend transverse to the wooden slats and alternate revolutions of the spiral springs are secured to the slats. At the top, the spiral springs are supported by the welded wire grid. Side edge reinforcement and resiliency is provided by coil springs, each of which is secured at the bottom to the wooden frame and at the top to the border wire and grid.

19 Claims, 5 Drawing Figures

BOX SPRING ASSEMBLY

This invention relates to bedding and more particularly to bed foundations or so-called "box springs" used for the support of bed mattresses.

Conventionally, bed foundations or "box springs" comprise a wooden rectangular base and transverse slats upon which rest coil springs. At the top the coil springs are usually tied together by a wire grid or by a series of interconnecting helical wires.

Customer demand is currently directed toward more rigid and less flexible bed foundations or box springs. To obtain that rigidity, the coil springs are either increased in number or in wire diameter. In either event, the result is a box spring which is more expensive to manufacture because of the increased cost of coil springs.

As one approach to increasing rigidity without increasing the cost, some bedding manufacturers have completely eliminated all springs and all resiliency from the box spring, as for example, by substituting rigid foam plastic such as foam polystyrene for the springs of the unit. This has the desired effect of a cost reduction and increased rigidity, but at the sacrifice of resiliency. Ideally, some resiliency should be retained, even in the most rigid bed foundation, to achieve the most comfortable and desirable combination of bed mattress and foundation.

Accordingly, it has been a primary objective of this invention to provide an improved box spring which has increased rigidity or firmness over conventional coil spring units but which is less expensive to produce and which still retains sufficient resiliency to yield under heavy loading conditions.

This objective is achieved and one aspect of this invention is predicated upon the concept of utilizing large diameter helical torsion springs which extend for the length or width of the box spring as a substitute for the coil springs of a conventional box spring unit. These helical torsion springs comprise helical wires in which less than all of the revolutions of the wire are secured at the bottom to slats of the wooden frame. At the top the helical torsion springs are secured to a grid of wires which extend between and are secured to a border wire of the box spring. Preferably, coil springs are located around the side edges or border of the unit to increase the edge firmness and resiliency of the unit.

One of the most important aspects of this invention resides in the concept of utilizing the helical wires of the box spring assembly as torsion springs to impart resiliency to the unit under heavy vertical loading conditions. We have found that if less than all of the revolutions of the helical wires are secured to and supported by the wooden slats, those revolutions located between points of attachment of the helicals to the slats act as torsion springs which move longitudinally upon vertical loading of the assembly. This longitudinal movement in effect causes the helical spring to act as a multitude of independent torsion springs, each of which acts relatively independently to resiliently absorb vertical loads on the assembly. Consequently, these "torsion springs" impart resiliency to the box spring unit in an inexpensive manner and in a manner which still retains the desired rigidity of the unit except under heavy loads.

We are aware that there is disclosed in U.S. Pat. No. 182,797 which issued Oct. 3, 1876, a bed bottom which utilizes flat sheet metal helical springs in lieu of conventional coil springs to provide the resiliency of the unit. That approach of utilizing flat sheet metal helical springs though is impractical by today's bedding standards from both a cost and resiliency standpoint.

The primary advantage of the box spring unit of this invention resides in its provision of a very rigid, yet relatively inexpensive, unit which still retains resiliency under heavy loading conditions.

These and other objects and advantages of this invention will be more readily apparent from the following detailed description of the drawings in which.

Figure 1:
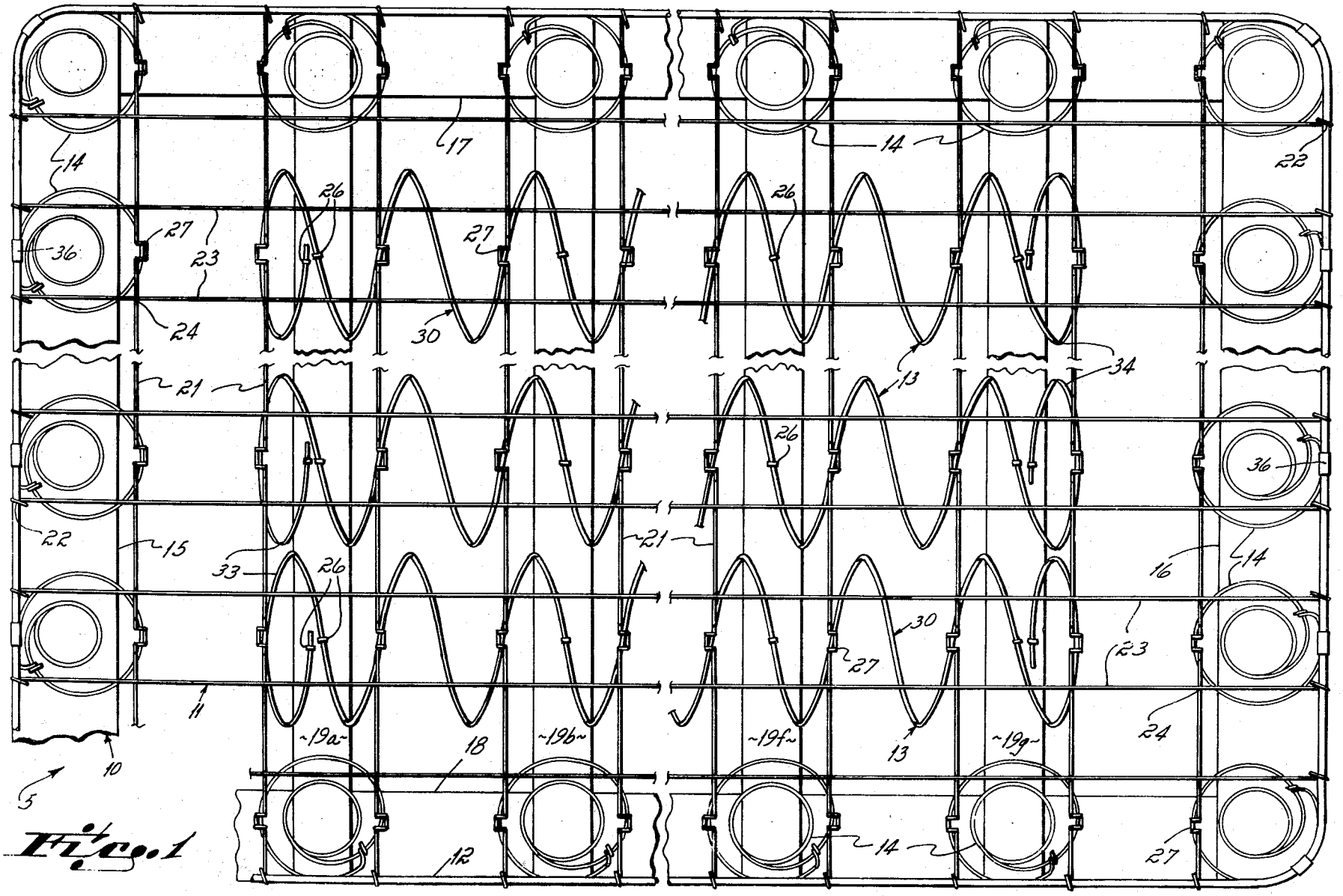
FIG. 1 is a top plan view, partially broken away, of a box spring assembly incorporating the invention of this application.

The box spring assembly 5 of this invention comprises a wooden base 10 located in the bottom plane of the assembly, a wire grid 11 and border wire 12 located in the top plane of the assembly, and a plurality of parallel helical springs 13 located between the base frame 10 and the wire grid 11. In the preferred embodiment there are also helical coil springs 14 located around the periphery of the assembly.

The base frame 10 comprises a pair of end boards 15, 16 and a pair of side boards 17, 18 which are stapled or nailed together to form a rectangular frame. Seven transverse slats 19 (only four, 19*a*, 19*b*, 19*f* and 19*g*, of which are illustrated) extend between and are nailed to the tops of the side boards 17 and 18. Depending upon the width of the assembly 5, there may be a longitudinal slat (not shown) nailed to the underside of the transverse slats 19 and to the end boards to provide support for the transverse slats approximately midway of their length.

The border wire 12 is formed into a rectangular configuration which overlies the peripheral edge of the rectangular frame elements 15, 16, 17 and 18. The wire grid 11 is secured to and located in the plane of the border wire 12. It comprises a plurality of transverse wires 21 and longitudinal wires 23 which extend between opposite sides of the rectangular border wire. At the ends, both the transverse wires 21 and longitudinal wires 23 wrap around the border wire 12, as illustrated at 22. Preferably, the ends of both the transverse wires 21 and the longitudinal wires 23 are welded to the border wire. The intersections of the transverse wires 21 and longitudinal wires 23 are also preferably welded together.

In practice, the border wire and top grid are all preformed into a welded wire subassembly. This subassembly is manufactured by placing the transverse wires 21, longitudinal wires 23, and border wire 12 within a fixture, and then spotwelding all of the intersections 24.

Figure 2:
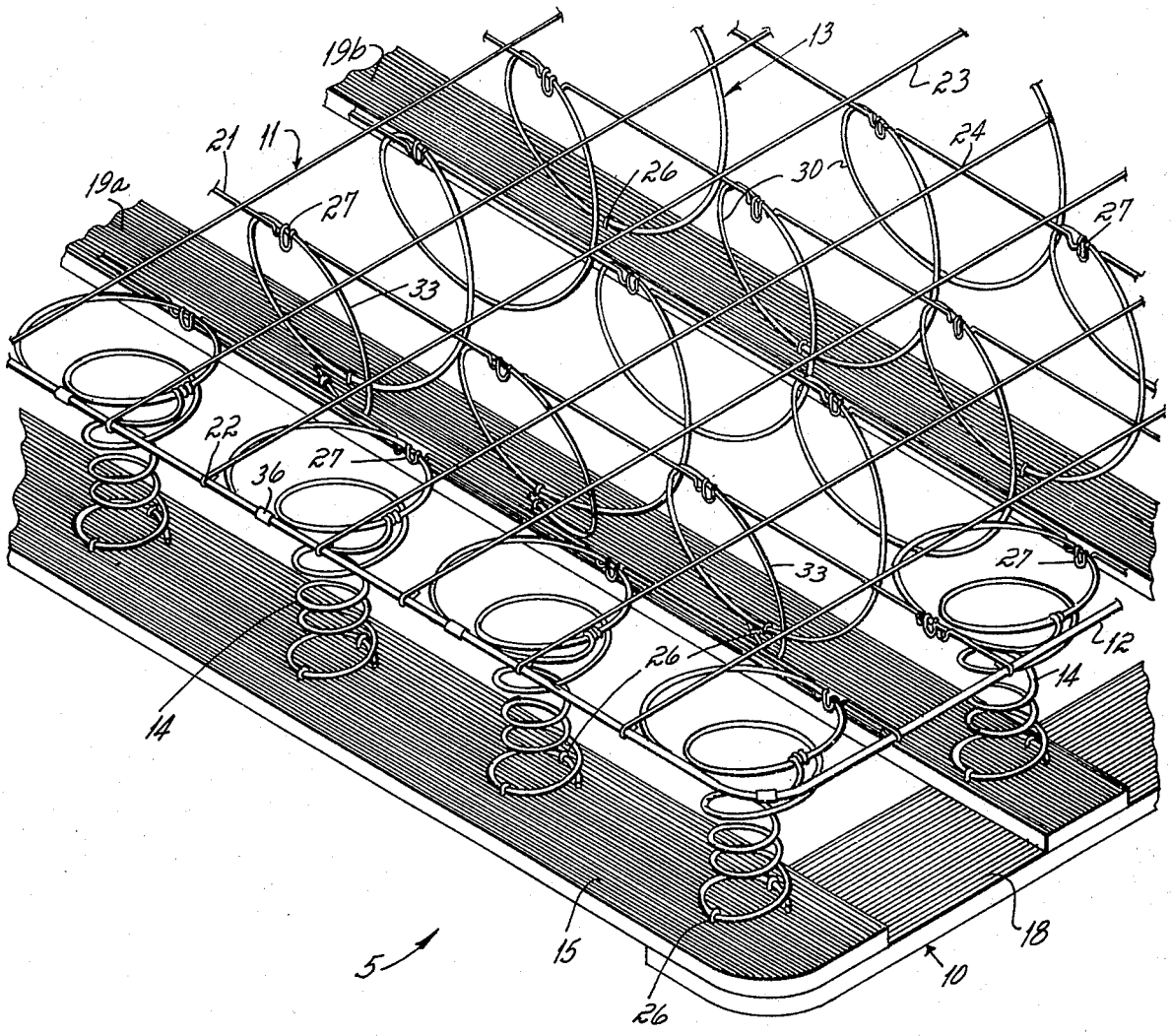
FIG. 2 is a perspective view of a corner portion of the box spring assembly of FIG. 1.
Figure 3:
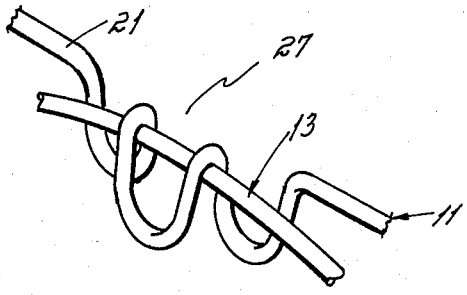
FIG. 3 is an enlarged perspective view of a connector between the spiral spring and wire grid of the box spring assembly of FIG. 1.

The resiliency of the box spring assembly 5 is afforded by the long helical wires (only three of which 13*a*, 13*d* and 13*e* are illustrated in FIG. 1). These helical wires 13 extend longitudinally for nearly the full length of the assembly and are secured to the wooden slats 19 and to the welded wire grid 11. As best illustrated in FIGS. 1 and 2 the end convolutions of each helical spring are secured to the end slats 19*a* and 19*g*. Between the end convolutions, every alternate convolution 30 of the helical wires is secured at the bottom to the slats 19 by conventional metal staples 26. Each convolution, as opposed to every alternate convolution, is secured at the top to the welded wire grid. The securement of the helical wires 13 to the grid is by U-shaped hook 27 pre-formed into the transverse wire 21 of the welded wire grid. The hooks 27 are formed as open U-shaped elements which open downwardly so that the grid may be placed over the helical wires with the upper portions of each loop located in one of the hooks. The open portions of the U-shaped configuration are then bent to a closed condition so as to lock the helical wires within the U-shaped sections of the transverse wires 21.

Figure 4:
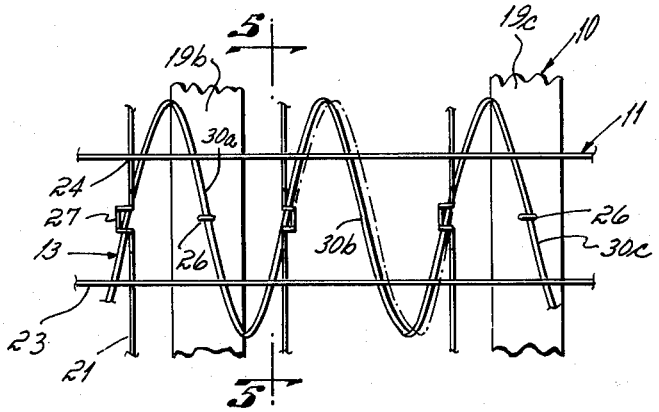
FIG. 4 is a top plan view of a portion of the box spring assembly of FIG. 1 illustrating in dashed lines the movement of the spiral spring when subjected to a vertical load.
Figure 5:
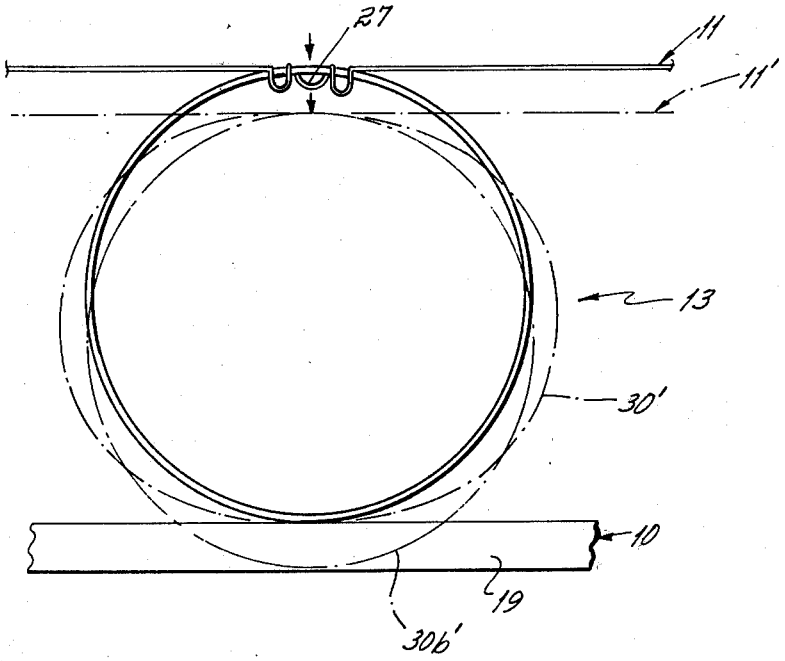
FIG. 5 is a cross sectional view taken on line 5—5 of FIG. 4 and illustrating in dashed lines the movement of the spiral spring when subjected to a vertical load.

Referring to FIGS. 4 and 5, there is illustrated the spring "action" which occurs upon vertical loading of the helical springs 13 of the unit because of the alternate convolutions being unsupported at the bottom by the slats 19. In FIG. 4, there are three full convolutions of spring 19 shown. At the top each convolution passes through a U-shaped hook 27 of the wire grid and is there clamped to the grid. At the bottom the first and third convolutions 30*a*, 30*c* are secured to the slats 19*b* and 19*c* by the staples 26. The central convolution 30*b* though is unsecured and unsupported by a slat so that it is free to move both vertically and axially when the helical spring 13 is forced downwardly. In practice, when the grid 11 is forced downwardly from the horizontal plane of the grid 11 (FIG. 5), to the horizontal plane 11' (FIG. 5), the first and third convolutions 30*a*, 30*c* deflect into the oval configuration depicted by the dashed line 30' of FIG. 5. The central unsupported convolution 30*b* though maintains its circular configuration but moves axially and twists as indicated by the dashed line 30*b*. Consequently, the unsupported convolution of each helical spring acts as an independent stiff torsion spring located between stiffer compression springs. The total effect is one of a very stiff but still resilient box spring assembly, the exact quality or feel of which is generally sought in all modern box springs.

With reference to FIG. 1, it will be seen that the helical wires 13 extend axially for less than the full length of the box spring assembly. The end convolution 33, 34 of each of the helicals 13 is attached to the endmost slats 19*a* and 19*g* respectively.

The edge support of the box spring assembly is provided by the helical coils 14. Each of these helical coils 14 is generally conical in shape when viewed in side elevation. Each coil has its smaller diameter end convolution secured by staples 26 to the top of one of the slats 19*a* through 19*g* or to the top of the end boards 15, 16. At the top, the largest convolution of each of the end coils is clipped to the border wire by a conventional metal clip 36 and is secured to the grid by a hook 27 formed in the transverse wires 21 of the grid 11. The side edge coils 14 have their top convolutions secured to the grid by a pair of hooks 27 formed in the transverse wires of the grid.

In one preferred embodiment of the box spring assembly 5, there are seven slats 19 equidistantly spaced between the two end boards 15 and 16. A side edge coil 14 is mounted atop the end of each of these slats 19. In addition to these seven side edge coils on each side of the assembly 5, there are four corner coils 14 and five end coils 14 at each end of the unit. Otherwise expressed, in the preferred embodiment of the invention, there are 28 coils 14 equidistantly spaced about the peripheral edge of the unit. There are five spiral springs 13 extending longitudinally of the unit in this preferred embodiment. Each of these sprial springs 13 is 6 inches in diameter and has a lead or pitch of 4 inches. The number of coil springs and spiral springs as well as their dimensions of course varies from one box spring to another depending upon the size and resilient properties of the unit.

The primary advantage of the box spring assembly heretofore described resides in the fact that it enables a very firm box spring assembly to be manufactured relatively inexpensively. The assembly though retains sufficient resiliency as a consequence of the independent torsion springs located throughout the length of the helical springs 13 to yield under heavy loading conditions. The inclusion of the helical springs 13 in place of the conventional coil springs of a box assembly provide a stiff box spring but without a sacrifice of resiliency and the coil springs 14 around the periphery of the assembly provides the desirable side edge resiliency.

While we have described only a single preferred embodiment of our invention, persons skilled in the box spring art will appreciate numerous changes or modifications which may be made without departing from the spirit of our invention. For example, the helical springs could extend transversely rather than longitudinally of the unit or the unit could include both longitudinal and transverse helicals. The important point is that in the practice of one aspect of this invention, some of the coils of the helical springs must be unsupported by slats while others are supported by the slats so that those unsupported coils are free to act as individual torsion springs to obtain the desired resilient characteristics of the spring assembly. Accordingly, we do not intend to be limited except by the scope of the following appended claims.

Having described our invention, we claim:

1. A box spring assembly for use in supporting a bed mattress, said assembly comprising a rectangular base frame located in the bottom plane of said box spring assembly, a plurality of slats extending between two opposite sides of said base frame, a rectangular border wire generally overlying said base frame, said border wire being located in a plane spaced from but parallel to the plane of said base frame, a grid of wires located in the plane of said border wire and defining the top plane of said box spring assembly, said grid comprising a plurality of longitudinal and transverse wires secured at their opposite ends to said border wire, and a plurality of parallel spiral spring wires extending generally perpendicular to said slats, and spiral spring wires being secured at the bottom to said slats and at the top to said grid of wires.

2. The box spring assembly of claim 1 which further includes coil springs located around the lateral edges of said box spring assembly, said coil springs being secured at the bottom to said base frame and at the top to said border wire.

3. The box spring assembly to claim 1 in which at least some of said longitudinal and transverse wires of said grid have generally U-shaped hooks formed therein, said U-shaped hooks wrapped around said spiral spring wires so as to secure said spiral spring wires to said grid of wires.

4. The box spring assembly of claim 1 in which less than all of the revolutions of each of said spiral spring wires are connected to said slats.

5. The box spring assembly of claim 1 in which less than all of the revolutions of each of said spiral spring wires overlies and is supported by one of said slats.

6. The box spring assembly of claim 1 in which each revolution of said spiral spring wires is connected at the top to said grid of wires.

7. The box spring assembly of claim 1 in which every other revolution of each of said spiral spring wires overlies and is secured to one of said slats, the revolutions located between said slats being unsecured and free to move both vertically and axially upon vertical loading of said box spring assembly.

8. A box spring assembly for use in supporting a bed mattress, said assembly comprising a rectangular base frame located in the bottom plane of said box spring assembly, a plurality of slats extending between two opposite sides of said base frame, a rectangular border wire generally overlying said base frame, said border wire being located in a plane spaced from but parallel to the plane of said base frame, a grid of wires located in the plane of said border wire and defining the top plane of said box spring assembly, said grid comprising a plurality of longitudinal and transverse wires secured at their opposite ends to said border wire, a plurality of parallel spiral spring wires, each of said spiral spring wires extending between opposite sides of said base frame, said spiral spring wires being secured at the bottom to said slats and at the top to said grid of wires, and a plurality of coil springs located along each side and at the corners of said box spring assembly, said coil springs being secured at the bottom to said base frame and at the top to said border wire.

9. The box spring assembly of claim 8 in which at least some of said longitudinal and transverse wires of said grid have generally U-shaped hooks formed therein, said U-shaped hooks being wrapped around said spiral spring wires so as to secure said spiral spring wires to said grid of wires.

10. The box spring assembly of claim 8 in which less than all of the revolutions of each of said spiral spring wires are connected to said slats.

11. The box spring assembly of claim 1 in which less than all of the revolutions of each of said spiral spring wires overlies and is supported by one of each slats.

12. The box spring assembly of claim 8 in which each revolution of said spiral spring wires is connected at the top to said grid of wires.

13. The box spring assembly of claim 8 in which every other revolution of each of said spiral spring wires overlies and is secured to one of said slats, the revolutions located between said slats being unsecured and free to move both vertically and axially upon vertical loading of said box spring assembly.

14. A box spring assembly for use in supporting a bed mattress, said assembly comprising a rectangular base frame located in the bottom plane of said box spring assembly, a plurality of slats extending between two opposite sides of said base frame, a rectangular border wire generally overlying said base frame, said border wire being located in a plane spaced from but parallel to the plane of said base frame, a grid of wires located in the plane of said border wire and defining the top plane of said box spring assembly, said grid comprising a plurality of longitudinal and transverse wires secured at their opposite ends to said border wire, and a plurality of parallel spiral spring wires extending generally normal to said slats, each of said spiral spring wires having less than all of its revolutions secured to said slats, said spiral spring wires being secured at the top to said grid of wires, and those revolutions of each of said spiral spring wires which are unsecured to said slats being free to move both vertically and axially upon vertical loading of said box spring assembly.

15. The box spring assembly of claim 14 in which at least some of said longitudinal and transverse wires of said grid have generally U-shaped hooks formed therein, said U-shaped hooks being wrapped around said spiral spring wires so as to secure said spiral spring wires to said grid of wires.

16. The box spring assembly of claim 14 in which every other revolution of each of said spiral spring wires is secured to one of said slats.

17. The box spring assembly of claim 14 in which said longitudinal and transverse wires are welded together at their intersections.

18. The box spring assembly of claim 14 in which each revolution of each of said spiral spring wires is connected at the top to said grid of wires.

19. A box spring assembly for use in supporting a bed mattress, said assembly comprising a rectangular base frame located in the bottom plane of said box spring assembly, a plurality of slats extending between two opposite sides of said base frame, a rectangular border wire generally overlying said base frame, said border wire being located in a plane spaced from but parallel to the plane of said base frame, a grid of wires located in the plane of said border wire and defining the top plane of said box spring assembly, said grid comprising a plurality of longitudinal and transverse wires and secured at their opposite ends to said border wire, and a plurality of parallel helical spiral spring wires, each of said helical spring wires extending between opposite sides of said base frame, said helical spring wires extending generally perpendicular to said slats, said helical spring wires being secured at the bottom to said slats and at the top to said grid of wires and each of said parallel helical spiral wires having an axis extending generally parallel to said top plane of said box spring.

* * * * *